United States Patent [19]

Slavik et al.

[11] Patent Number: 4,595,151

[45] Date of Patent: Jun. 17, 1986

[54] BOBBIN INSERTING DEVICE

[75] Inventors: Walter Slavik; Rudolf Luz, both of Horgen, Switzerland

[73] Assignee: Rieter Machine Works, Ltd., Winterthur, Switzerland

[21] Appl. No.: 611,675

[22] Filed: May 18, 1984

[51] Int. Cl.[4] ..... B65H 54/02; B65H 54/553; B65H 54/26

[52] U.S. Cl. ..... 242/18 DD; 242/18 PW; 242/35.5 A

[58] Field of Search ..... 242/18 PW, 18 DD, 35.5 A, 242/35.5 R, 35.6 R; 57/279, 268, 269, 270

[56] References Cited

U.S. PATENT DOCUMENTS

| | | | |
|---|---|---|---|
| 3,791,126 | 2/1974 | Kose et al. | 242/35.5 A |
| 3,858,816 | 1/1975 | Corbiere | 242/18 PW |
| 3,940,077 | 2/1976 | Ohashi | 242/35.5 A |
| 3,971,520 | 7/1976 | Shimai | 242/35.5 A |
| 4,015,786 | 4/1977 | Slavik et al. | 242/35.5 A |
| 4,019,690 | 4/1977 | Gujer et al. | 242/18 PW |
| 4,093,135 | 6/1978 | Hermanns | 242/18 PW |
| 4,125,990 | 11/1978 | Stahlecker et al. | 242/35.6 R X |
| 4,139,162 | 2/1979 | Stahlecker | 242/35.5 A |
| 4,154,409 | 5/1979 | Reisser et al. | 242/18 PW |
| 4,154,411 | 5/1979 | Kamp et al. | 242/35.5 R |
| 4,195,788 | 4/1980 | Miyazaki et al. | 242/18 PW |
| 4,352,466 | 10/1982 | Baumges et al. | 242/35.5 A X |
| 4,399,951 | 8/1983 | Preuhs | 242/35.5 A X |

FOREIGN PATENT DOCUMENTS

| | | | |
|---|---|---|---|
| 2640312 | 3/1978 | Fed. Rep. of Germany | 242/35.5 A |
| 2828868 | 1/1979 | Fed. Rep. of Germany | 242/35.5 A |
| 2826392 | 5/1979 | Fed. Rep. of Germany . | |
| 2816418 | 10/1979 | Fed. Rep. of Germany | 242/35.5 A |
| 1226932 | 2/1960 | France . | |
| 2247906 | 5/1975 | France . | |
| 132269 | 10/1981 | Japan | 242/35.5 A |
| 876212 | 8/1961 | United Kingdom . | |
| 2039552 | 8/1980 | United Kingdom | 242/35.5 A |

*Primary Examiner*—Stanley N. Gilreath
*Attorney, Agent, or Firm*—Kenyon & Kenyon

[57] ABSTRACT

The bobbin gripper employs a pair of roller assemblies which are skewed relative to the axis of the bobbin carried by the gripper in order to impose an axial force on the bobbin. The force is used to press the bobbin towards one arm of the cradle mechanism when the mechanism is reopened for yarn clamping.

The thread reserve forming device employs a pivotally mounted part which cooperates with a second part to position a yarn in three positions in order to form a yarn reserve while also overlapping a tail extending from the yarn reserve towards an original clamping force.

9 Claims, 8 Drawing Figures

Figure 3:
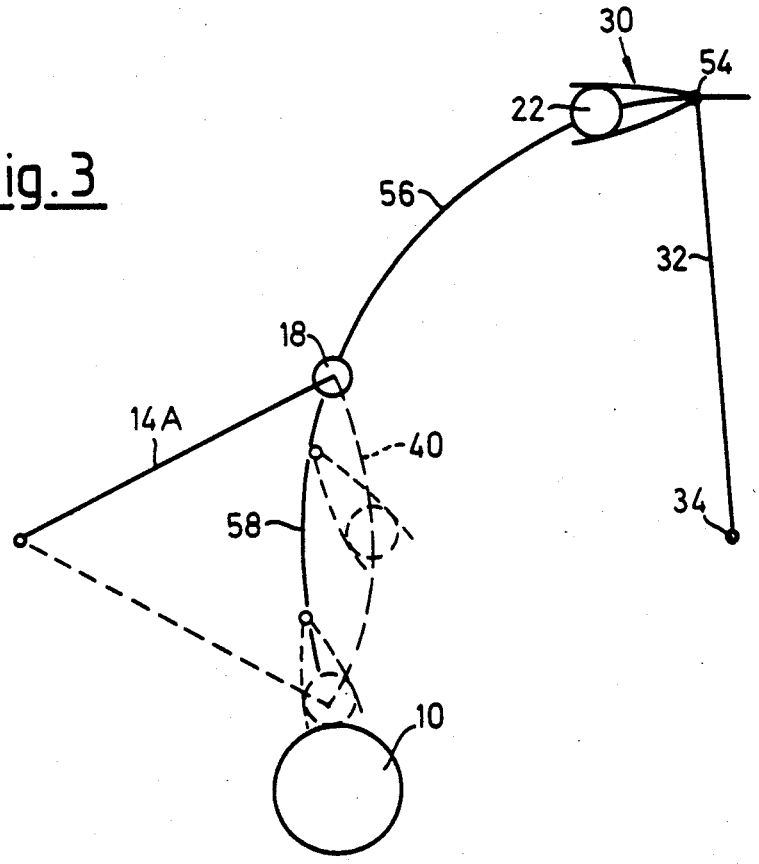

Fig.1
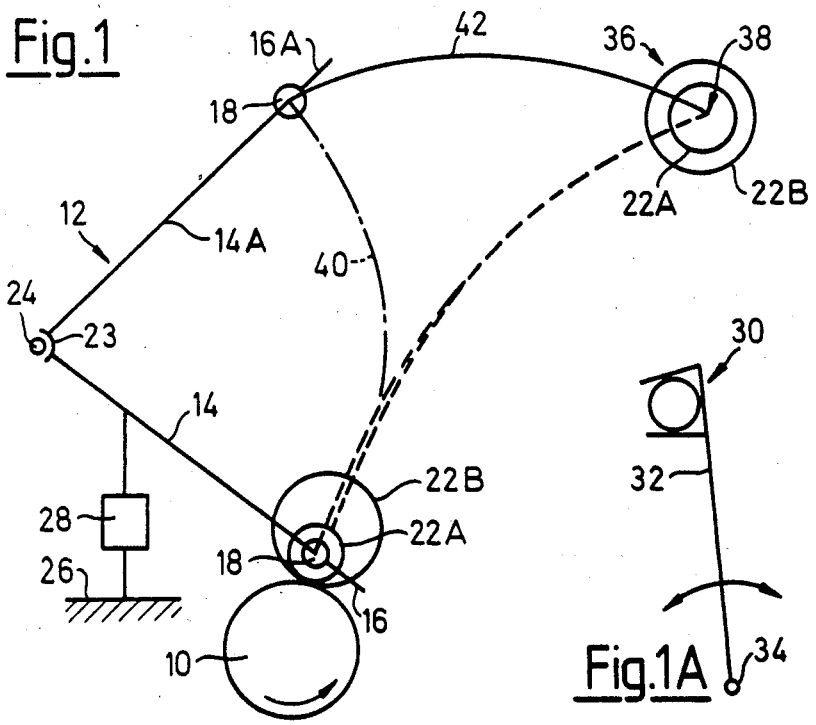
Fig.1A
Fig.2
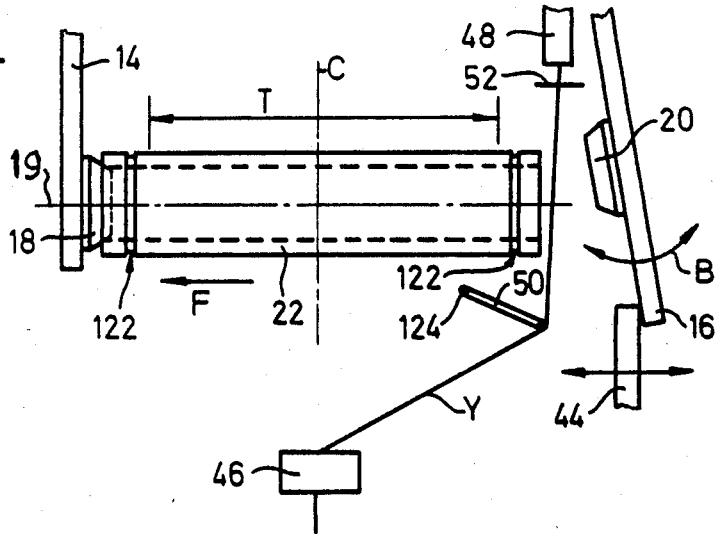

BOBBIN INSERTING DEVICE

The present invention relates to improvements in yarn handling machines of the type having a plurality of operating stations each including a yarn wind-up apparatus comprising a friction drive roll and a cradle means for holding a bobbin tube/yarn package in contact with the friction drive roll during formation of a yarn package on the bobbin tube. Such machines include, in particular but not exclusively, rotor spinning machines; other examples include automatic rewinders for rewinding cops into cross-wound packages and false twist texturising machines. By way of example only, examples of the type of wind-up mechanism involved can be seen from the following patent specifications-German No. 2649156, U.S. Pat. No. 3,356,306 and GB No. 1399891.

When starting winding at any one operating station, it is necessary to insert a bobbin tube into the cradle device and to connect a yarn to the inserted tube. It is now well known to perform such operations by means of a travelling service tender which is movable to and fro past the operating stations and can stop in alignment with any one of them to perform the required operations thereon.

It is also well known to provide such a tender with a bobbin inserting device in form of a pivotable arm provided at its free end with a bobbin gripper. Furthermore, the bobbin grippers have been provided with rollers to engage the bobbin tube so as to permit rotation of the tube while it is held by the gripper. This has been done for varying purposes; e.g. in U.S. Pat. No. 3,948,452, in order to enable acceleration of the incoming bobbin tube to the full winding speed; in German published patent application (Offenlegungsschrift) No. 2503545, in order to enable the start of winding of a new package to be effected practically simultaneously with the ejection of a full package and in German published patent application (Offenlegungsschrift) No. 3039857, to enable rotation of the incoming bobbin tube at a speed higher than the normal winding speed during formation of a thread reserve.

It has also been proposed in Swiss Pat. No. 625187 and U.S. Pat. No. 4,352,466 that the incoming bobbin tube should be transferred from the bobbin inserting device to the cradle mechanism at an intermediate position on the arc of swing of the cradle mechanism such that the bobbin tube is not then in contact with the friction drive roll. This enables temporary insertion of transmission rollers between the friction drive roll and the incoming bobbin tube, so that the tube can be rotated at a speed lower than the normal winding speed during formation of a thread reserve. The final stage of movement between the intermediate position and the normal winding position is effected only by movement of the cradle mechanism, the bobbin inserting device being withdrawn from contact with the bobbin tube.

The transfer location may be such that, at least for smaller diameter bobbins, an inserted bobbin is moved by the cradle mechanism from the transfer position to a winding position in which the bobbin contacts the friction drive roll of the relevant operating station.

YARN CLAMPING

Furthermore, in those prior specifications describing systems in which a bobbin is inserted into a cradle mechanism at a transfer location and is moved by the cradle mechanism from the transfer location to a winding position in contact with a friction roll (i.e. in Swiss specification No. 625187 and U.S. Pat. No. 4,352,466), the yarn must be secured to the bobbin while the latter is at the transfer location to enable subsequent winding of a thread reserve prior to movement of the inserted bobbin to the winding position. Accordingly, an undesirable yarn path length variation is produced during the final movement of the bobbin from the transfer location to the winding position.

The present bobbin inserting device may comprise a carrier member carrying the bobbin gripper and movable to move the bobbin gripper along its bobbin insertion path. The carrier member may be further movable to move the bobbin gripper to hold an inserted bobbin in the winding position to which it has been moved by the cradle mechanism. For this purpose, the bobbin gripper may be adjustably mounted on the carrier member. The cradle mechanism may then be releasable after the bobbin is located in the winding position to enable clamping of the yarn between the cradle mechanism and the inserted bobbin. Conveniently, the gripper is adapted to urge the bobbin against a part of the cradle mechanism after the release of the latter; this feature enables continued axial location of the bobbin and simultaneous angular location of the cradle.

THREAD RESERVE

None of the above mentioned prior specifications shows a system capable of producing an "overwrapped" thread reserve. Such reserves are already known and are described, e.g., in U.S. Pat. Nos. 1,477,162, 2,036,121, 3,385,532 and 3,858,816 and also in British patent specification No. 1520643. In all of those prior systems, however, the arrangement depends upon positive movement of the thread by suitable mechanical guide means.

Figures 4, 4A, 4B:
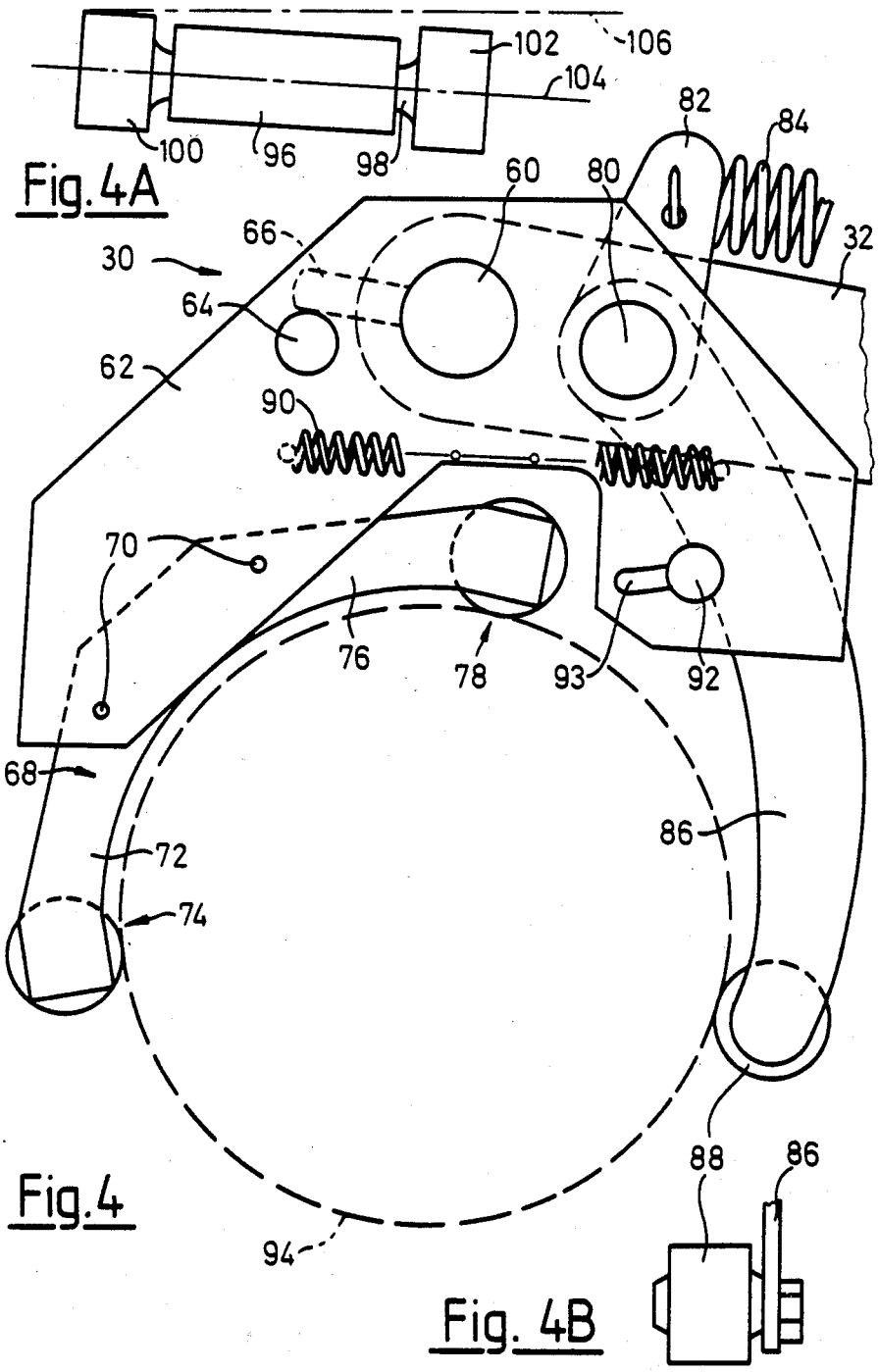
Figure 5:
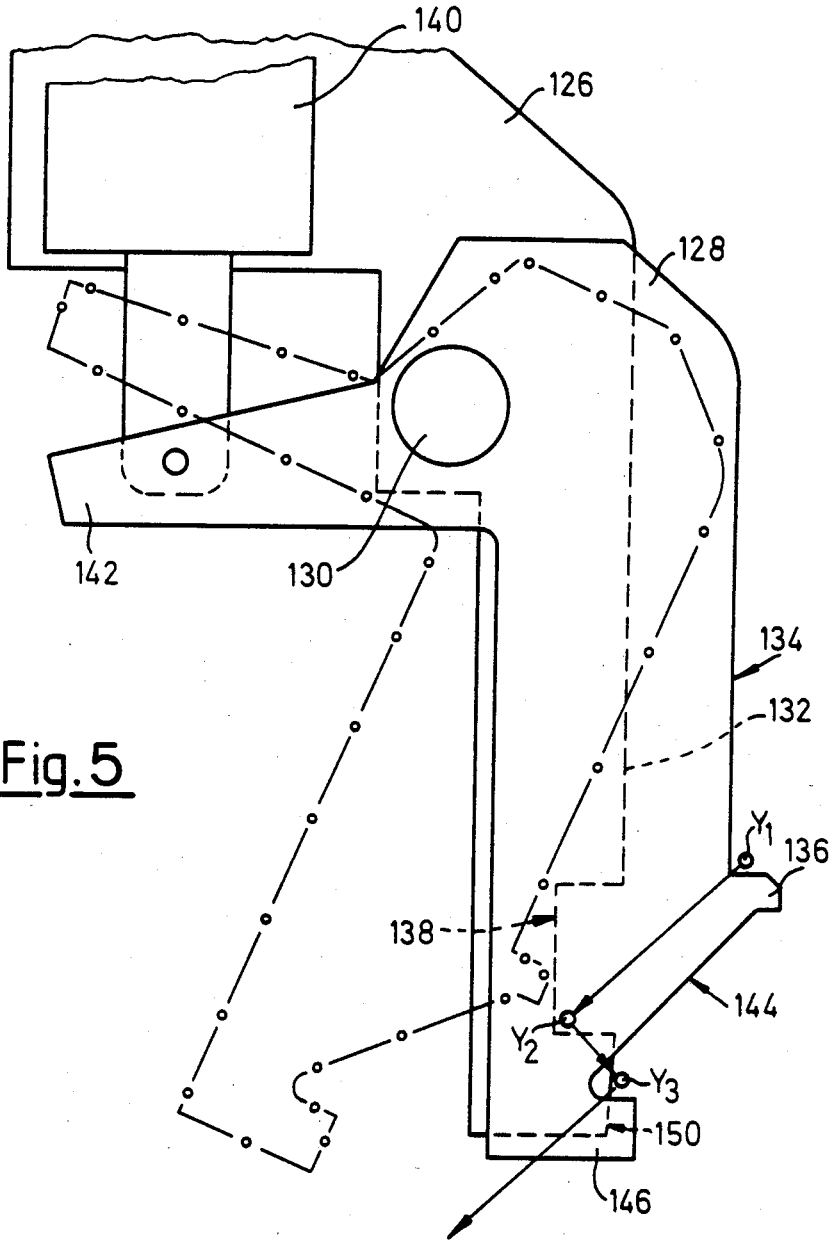

Further details of the invention will now be given by reference to the accompanying diagrammatic drawings, in which FIG. 1 is a diagrammatic representation of a cradle mechanism and a bobbin inserting system showing the effect of varying bobbin diameter, FIG. 1A being on a different scale, FIG. 2 is a more detailed (but still diagrammatic) view of part of a cradle mechanism in association with a thread reserve forming device, FIG. 3 is a diagram illustrating a second aspect of a bobbin inserting system, FIG. 4 is a side-view of a bobbin gripper suitable for handling varying bobbin diameters, FIG. 4A diagrammatically illustrates a roller assembly of a gripper to impart an axial force on a received bobbin, FIG. 4B illustrates a view of a mounting of a gripping roller of the gripper in accordance with the invention, FIG. 5 is a side view of a thread reserve forming device suitable for use in the system according to FIG. 2.

GENERAL

FIG. 1 shows in diagrammatic side elevation a friction drive roll 10 and a bobbin cradle mechanism generally indicated by the numeral 12. The cradle mechanism comprises a pair of arms 14, 16 which are aligned with one another as viewed in FIG. 1 so that only the nearer arm 14 is fully visible in that figure. Arm 16 is slightly longer than arm 14 so that its end portion can be seen in FIG. 1. Each arm carries a respective centering plate 18, 20 (better seen in FIG. 2) which in use carry between them a cylindrical bobbin tube 22.

Arms 14, 16 are carried by a carrier 23 (FIG. 1) which is pivotable about a bearing element 24 mounted in the machine structure. Arm 14 is fixed to the carrier, but arm 16 is pivotally mounted thereon for movement towards and away from the arm 14 as indicated by the double-headed arrow B in FIG. 2. Arm 16 has a normal position approximately parallel to arm 14 such that bobbin tube 22 is clamped between the plates 18 and 20. However, when arm 16 is pivoted away from arm 14 as shown in FIG. 2, a space is made for release of a yarn package formed on the bobbin tube 22 and/or insertion of a fresh bobbin tube between the centering plates.

Cradle mechanism 12 further comprises a cradle loading device 28 (FIG. 1). Device 28 is fixed at one end to the machine structure 26 and at the other end to the cradle comprising carrier 23 and arms 14,16. The loading device includes a biasing means (usually a spring-weighted device) which normally tends to draw the arms 14, 16 downwardly as viewed in FIG. 1 into a winding position in which a bobbin tube 22 carried by the arms engages the friction roll 10. Roll 10 is driven into rotation about its own longitudinal axis as indicated by the arrow in FIG. 1, and the plates 18, 20 are rotatable about axis 19 on the arms 14, 16 so that the bobbin tube 22 is rotated by frictional engagement with the roll 10. When a yarn is secured to the bobbin tube, therefore, it will begin to wind on the tube and a suitable traverse guide means (not shown) is provided to enable formation of a cross-wound package is a well-known manner. The arms 14, 16 can, however, be swung upwardly on the bearing element 24 to an uppermost position 14A, 16A in FIG. 1 and the loading device 24 has an over-centre system such that the weighting means is ineffective to draw the arms downwardly out of this uppermost position.

The arrangement thus far described is very well-known and widely used on several different textile machines, e.g. rotor spinning machines, automatic rewinding machines and false twist texturising machines. By way of example only, the arrangement as applied to open-end spinning machines can be seen in British Pat. No. 1349425.

In a practical yarn handling machine (whether a spinning machine, winding machine, texturising machine or any other type) there are normally a large number of operating stations arranged side by side along an elongated frame of the machine. In current machine design, up to 100 operating stations per machine side are common. Each operating station has its own cradle mechanism 12; the stations may also have respective friction drive rolls 10, or there may be a common roller extending for the full length of one machine side. It is now common practice to effect both package ejection and bobbin insertion automatically in such a machine so to reduce the manual attendance required. The devices required to perform these operations automatically may be provided at the individual spinning stations, but for economic reasons it is preferred to provide a service tender which is provided with one set of ejection/insertion devices and which is movable longitudinally of the machine past the stations. Means is provided to locate the tender in alignment with any selected station in order to enable performance of ejection/insertion operations thereon. In the following description, the use of a service tender will be assumed, but it will be apparent that the principles described could also be applied to multiple ejection/insertion devices.

BOBBIN INSERTION

Bobbin insertion is commonly effected by means of a bobbin gripper 30 (FIG. 1A) mounted at the end of an arm 32 which is pivotable about a pivot mounting 34 in the service tender. The gripper collects a bobbin from a bobbin holder (not shown) in an upper portion of its swinging movement about the mounting 34, and then moves the bobbin to a position at which the bobbin can be transferred to the cradle mechanism 12. The bobbin holder may be on the service tender or on the machine, but in the latter case one bobbin holder per operating station is required.

In many yarn handling machines, it is common practice to design the machine to accept bobbins of radically different external diameter. This provides substantially increased flexibility for the machine user in providing varying packages for varying end-user requirements. By way of example only, bobbin diameters used by spinning mills on rotor spinning machines may vary between approximately 60 and 105 mm. Assume now that a "bobbin collection position" 36 (FIG. 1) is defined at which the gripper 30 collects a bobbin presented to it by a suitable bobbin holder. Assume further that the holder is designed to hold all bobbin axes 38 at a predetermined location in the bobbin collection position, regardless of varying external diameters 22A and 22B respectively. It will be seen, however, that when these bobbins are in their respective winding positions in contact with the drive roll 10, their axes are spaced along the arc 40 swept out by the axis 19 during pivotal movement of the arm 14, 16. Accordingly, if the bobbin insertion device shown in FIG. 1A attempts to bring bobbins of varying diameters to their respective winding positions, for insertion into the cradle mechanism at those winding positions, then the movement mechanism for the bobbin insertion device requires adaptation in dependence upon the bobbin diameter and such system adaptation is highly undesirable since it involves complex movement setting operations. Further, the tender must control the cradle position.

The above disadvantages can be avoided by a system in which the bobbin insertion device does not insert bobbins into the cradle mechanism at the winding position, but at a "transfer location" which is spaced from the winding position. In the preferred embodiment shown in FIG. 1, this transfer location is defined by the uppermost position of the cradle. This uppermost position of the cradle (and, correspondingly, the transfer location) is the same for all bobbin diameters. It is not essential to use the uppermost position of the cradle to define the transfer location, which could be shifted along the arc 40 towards the friction roller 10 as far as the winding position of the largest diameter bobbin for which the machine is designed. However, the uppermost position of the cradle is preferred because it is a closely defined position in which the cradle is held in a stable condition without direct intervention of the service tender.

As indicated by the curve 42 ("bobbin insertion path") in FIG. 1, the path of movement of the bobbins between the collection position and the transfer location is the same regardless of bobbin diameter. Accordingly, while it is necessary to adapt the bobbin holder and the bobbin gripper to varying bobbin diameters, it is no longer necessary to adapt the movement defining system for the bobbin insertion device. The illustrated examples assume a pivotal movement for the bobbin insertion device, defining curved bobbin insertion paths. It will be apparent, however, that the principles are the same for a reciprocatory bobbin insertion device defining straight bobbin insertion paths.

In order to enable insertion of a bobbin into the cradle at the transfer location, the cradle must be "opened" i.e. arm 16 must be pivoted away from its normal, parallel di position relative to arm 14 to create space, so that the gripper 30 can bring the bobbin to a position in which the bobbin is substantially coaxial with the axis 19 (FIG. 2). The cradle must then be "closed", i.e. arm 16 must be returned to its normal disposition so that the bobbin is clamped between the plates 18, 20. These movements of the arm 16 can be effected by a lever (not shown in FIG. 1) mounted in the service tender and operable by means to be described later. Such devices are now well-known in the art. An inserted bobbin is moved to its respective winding position by downward movement of the cradle from its uppermost position as viewed in FIG. 1. This movement can also be effected by a suitable lever provided on and operated by the tender. The bobbin insertion function of the gripper 30 is therefore completed when the bobbin is transferred to the cradle. However, for reasons which will now be explained, it may be desired to have the gripper hold the bobbin also in its winding position.

YARN CLAMPING

Consider now the diagram of FIG. 2 in further detail. The bobbin 22 is assumed to be already in its winding position in contact with the friction roller 10. However, the cradle is illustrated in its open or "release" condition with the arm 16 pivoted away from its normal disposition relative to the arm 14. Again, this is effected by a lever diagrammatically indicated at 44 in FIG. 2 mounted on and operated by the service tender. This re-opening of the cradle with the bobbin in the winding position enables extension of a yarn Y through the gap between the righthand end of bobbin 22 (as seen in FIG. 2) and the plate 20 on arm 16. If arm 16 is now returned to its normal disposition, this closing of the cradle will clamp the yarn Y between the bobbin end and the plate 20, thereby effectively securing the yarn to the bobbin for winding of a package thereon. Such clamping systems are well-known in the art.

Conveniently, the gripper 30 is used to hold the bobbin in the winding position during opening of the cradle in the course of the clamping operation. Although not illustrated in FIG. 2, the gripper 30 remains in gripping contact with bobbin 22 and urges it towards the left as viewed in that figure into continued contact with the plate 18. The clamping end of the bobbin (the righthand end as viewed in FIG. 2) is therefore accurately located during the clamping operation. A gripper design suitable for this purpose will be described in further detail later.

The yarn Y is commonly fed to the wind-up system from a guide system indicated generally by the numeral 46 in FIG. 2. When the yarn is secured to the rotating bobbin 22, the resulting yarn tension tends to draw the yarn into the shortest yarn path between the guide system 46 and the package forming on the bobbin 22. Normally, and in accordance with the assumption represented in FIG. 2, the shortest yarn path lies on the centre line C at the mid-length of the bobbin 22.

For purposes of securing the yarn to the bobbin 22 in order to start winding of a package, the yarn end is taken up by a yarn manipulating device 48. The form of this device will depend substantially upon the type of machine with which it is to be used. In a machine in which yarn is being forwarded towards the wind-up system (e.g. a spinning machine), the manipulating device 48 should also be a take-up device such as a suction pistol. Where yarn forwarding is dependent upon the wind-up itself, the manipulating device does not have to be a take-up. In any event, the manipulating device 48 is provided on and moved by the service tender.

Device 48 takes the yarn from the guide system 46 and extends it through the gap created by opening of the cradle between the bobbin 22 and the plate 20. The length of yarn which is to be clamped to the bobbin end should extend approximately at right angles to the axis 19. In order to ensure this, the yarn is acted on by auxiliary guide 50 which will be described in further detail below and which is also carried by the tender. As soon as the yarn is clamped to the bobbin by closing of the cradle, the length of yarn extending between the bobbin and device 48 is drawn by rotation of the bobbin against a knife edge indicated diagrammatically at 52. The knife is secured to the manipulating device 48 so that it remains spaced from the yarn until the latter is drawn into rotation. By this means, a short yarn tail is produced projecting from the clamping point, and the remainder of the yarn connected to device 48 is removed by the tender when it retracts the device 48 and knife 52.

MATCHING GRIPPER AND CRADLE MOVEMENTS

FIG. 3 shows the principle of matching of the gripper movement after bobbin insertion to the movement of the cradle between the transfer location and the bobbin winding position. The numerals used correspond with those used in description of FIG. 1, although the path of movement of the gripper 30 is different to that previously illustrated. There is an additional feature as compared with FIG. 1, namely that the gripper 30 is pivotally mounted on the arm 32 by a pivot mounting 54. Biasing means (not shown) hold the gripper 30 in a normal position relative to the arm 32, in which position the gripper 30 can collect a bobbin from the non-illustrated bobbin holder. Gripper 30 remains in this normal position during movement along the bobbin insertion path 56 from the collection location to the transfer location. Transfer of the bobbin from gripper 30 to the cradle is effected in the manner described above.

In FIG. 1, the bobbin inserting device would be retracted after insertion of a bobbin into the cradle. In FIG. 3, however, the anti-clockwise pivotal movement of the arm 32 continues even after bobbin insertion has been completed with the pivot mounting 54 moving along the extension 58 of the bobbin insertion path 56. The paths 56 and 58 can together be taken to define a "gripper path".

Simultaneously, the cradle is moved downwardly under the control of suitable levers on the tender to move the bobbin clamped therein from the transfer location to the winding position. The gripper path 56, 58 is arranged to intersect the arc 40 in the region of the bobbin winding positions. In this way, it is ensured that the gripper 30 is efficiently oriented relative to its arm 32 in order to hold the bobbin 22 in the winding position during the clamping operation as described with reference to FIG. 2.

In addition, however, it is desired to maintain a hold of the gripper 30 on the bobbin 22 between the transfer location and the winding position. This avoids any necessity for the gripper to re-grip the bobbin after it has arrived at the winding position. Such continued hold of the gripper on the bobbin during movement of the gripper along the path section 58 is enabled by pivoting of the gripper 30 on its pivot mounting 54 against the effect of its biasing means. The movements of the arm 32 and of the cradle lowering control lever on the tender can be coordinated by a suitable programming system (to be described further hereinafter) so that the bobbin clamped in the cradle remains within the holding range of the gripper 30 throughout movement of the latter along the path section 58.

FIG. 4 shows a side elevation of one form of bobbin gripper suitable for the system shown in principle in FIG. 3. The carrier arm 32 is illustrated also in FIG. 4. At its free end, arm 32 carries a bearing shaft 60, the axis of the shaft 60 extending transversely to the length of arm 32. Two plates 62 (only one of which can be seen in FIG. 4) are spaced along shaft 60 on the same side of arm 32. Each plate is secured against movement axially of the shaft 60 but is free to rotate around the axis of the shaft. The plates are secured together by a cross piece 64 for joint rotation about the shaft axis. This rotation is limited in one direction, however, by abutment of the cross piece 64 with a pin 66 secured in shaft 60 and extending radially therefrom.

Each plate can be considered to have two "legs" extending away from shaft 60. The longer legs, (to the left as viewed in FIG. 4) carry between them a yoke 68 which has a shallow U-shape. The bend of the U is secured by pins 70 to the plates 62. One arm 72 of the U forms an extension of the longer legs of the plates 62, and carries at its free end a roller assembly 74 which will be described further below. The other arm 76 of the U extends into the space between the legs of the plate 62 and carries at its free end a roller assembly 78, similar to the assembly 74.

Mounted between the shorter legs of the plates 62 is a bearing pin 80. Pin 80 is fixed to the plates and carries a projecting lug 82 which is connected to one end of a tension spring 84, the other end of which (not seen) is connected to the arm 32. Spring 84, by its action on lug 82, tends to pivot plates 62 in a clockwise direction (as viewed in FIG. 4) about the bearing shaft 60, so that cross piece 64 is normally urged against abutment 66.

An arm 86 is mounted on pin 80 for pivotal movement about the axis of the pin. Arm 86 forms an extension of the shorter legs of plates 62, and carries at its free end a single roller 88. A tension spring 90 is secured between plates 62 and arm 86 so as to draw the roller 88 towards the roller assemblies 74, 78. This movement is limited by a stop 92 extending between the shorter legs of the plates 62 and engaged by the arm 86. Stop 92 is adjustable in position along slot 93.

The dotted line 94 in FIG. 4 indicates the outline of a bobbin gripped by gripper 30. Arms 72 and 86 extend around more than half of the circumference 94 so that the roller 88 and the rollers of assembly 74 retain the bobbin in the gripper. The gripper can open to take up and release a bobbin by pivoting of arm 86 on pin 80 against the bias of spring 90. Penetration of the bobbin into the gripper is limited by the roller assemblies 78. In its approach movement to collect a bobbin, shaft 60 is moved along a rearward extension of the bobbin insertion path and the fully open "face" of the gripper is presented to the bobbin to be collected. At the collection stage, the gripper is held by spring 84 in its normal disposition, i.e. with cross piece 64 engaging abutment 66. The gripper maintains this normal disposition relative to arm 32 until it arrives in the transfer location.

During movement of the shaft 60 along the gripper path section 58 (FIG. 3), the path of the bobbin is determined by the cradle mechanism. However, the gripper maintains a hold on the bobbin throughout movement thereof from the transfer location to the winding position. In order to enable this, plates 62 pivot in an anticlockwise direction as viewed in FIG. 4 around shaft 60, i.e. cross piece 64 pivots away from abutment 66, against the bias supplied by spring 84. The degree of pivot about shaft 60 reaches a maximum at the maximum spacing of the arc 40 and path 58, and the gripper 30 returns to its normal disposition, or a disposition very close thereto, as the bobbin reaches its winding position. The degree of pivot is exaggerated in FIG. 3 for ease of illustration of the principle.

The force F (FIG. 2) urging bobbin 22 towards plate 18 during the clamping operation is produced by the roller assemblies 74 and 78. As seen in FIG. 4A, each assembly comprises a bearing box 96 secured to the free end of the arm 72 or 76 and providing a bearing for a shaft 98 carrying a roller pair 100, 102. However, the axis 104 of the shaft 98 is skewed relative to the axis of the bobbin carried by the gripper. This is illustrated in FIG. 4A by means of a line 106 which can be assumed to lie parallel to the bobbin axis and hence parallel to the axis of shaft 60. The skew of the shaft axis 104 is sufficient to produce a net axial force on the bobbin when the latter is rotated in contact with the rollers 100, 102, the roller assemblies 74, 78 acting in unison to produce the required force F.

The gripper can be adapted to varying bobbin diameters by releasing the yoke 68 from the plates 62 and replacing it with an alternative yoke appropriate to the new bobbin diameter to be used. If required, the stop 92 can also be adjusted relative to the plates 62 in order to adapt to the new bobbin type. Instead of a replaceable yoke 68, arms 72, 76 could of course be separately mounted on the gripper body provided by the plates 62, these arms being releasably secured in positions appropriate to the bobbin type to be used.

THREAD RESERVE

Consider once again the diagram shown in FIG. 2. A traverse guide (not shown) of well-known type is provided to traverse the yarn axially of bobbin 22 to build up a package in the traverse zone T. Between the traverse zone and the clamping end of the bobbin, a circumferential groove 122 is provided in which a thread reserve is to be formed. As is well-known, such a reserve is used to enable knotting together of successive packages in further processing of the packaged yarn. The similar groove 122 at the opposite end of the package has no function in the present instance, but is provided so that the bobbin is symmetrical about its centre line C and there is no need for a specific bobbin orientation prior to insertion. The auxiliary guide 50 functions as a reserve-forming guide, as will now be described.

Assume that the cradle shown in FIG. 2 has been re-closed to clamp the yarn Y as described. Assume also that guide 50 is pivotable about a mounting 124. Immediately after clamping of the yarn, guide 50 is pivoted in a clockwise direction as viewed in FIG. 2 on its mounting 124. The yarn is no longer restrained by guide 50, but is now tensioned because it is secured to the rotating bobbin 22. Accordingly, the yarn will tend to adopt the shortest path along the line C as described above. Guide 50 pivots sufficiently far in the clockwise direction to permit yarn Y to reach the groove 122, but movement of the yarn axially beyond groove 122 away from the clamping point is prevented. Accordingly, a predetermined number of reserve windings can be formed in the groove. Guide 50 is then pivoted in an anti-clockwise direction on its mounting 124 so as to push the yarn back towards the clamping end of the bobbin. The anti-clockwise movement of guide 50 is, however, terminated before the yarn reaches the bobbin end, and guide 50 is pivoted once again in the clockwise direction so that it exerts no further restraining action on the yarn Y. The windings formed during these brief pivotal movements of the guide 50 overwrap the length of yarn extending between the groove 122 and the clamping point and also the groove 122 itself. The tail extending from the reserve groove back towards the clamping point will, therefore, be locked in position even after release of the eventual completed package from the cradle.

A preferred embodiment of a reserve-forming mechanism operating on this principle will now be described with reference to FIG. 5.

The mechanism of FIG. 5 is basically a two-part structure, one part 126 being fixed and the second part 128 being pivotally mounted at 130 on the first. Each part is in the form of a bar extending away from the pivot 130, and the bars provide thread guiding edges 132, 134 respectively. The plane of each bar extends approximately at right angles to the yarn Y, with the yarn initially engaging the guide edge 134 of the pivotable bar 128. When the reserve-forming mechanism is in its initial position (full lines in FIG. 5), edge 134 is aligned with the gap between the clamping end of bobbin 22 and the plate 20 on the opened cradle during extension of the yarn Y through that gap preparatory to clamping. The yarn is retained in contact with edge 134 because it rests on a nose 136 projecting from that edge.

In the initial position, edge 132 is spaced to the left of the edge 134 as viewed in both FIG. 5 and FIG. 2. Edge 132 has a yarn receiving slot 138, the base of which is aligned with the groove 122 of bobbin 22 so as to retain the yarn in the groove. The yarn is released for movement into the groove 122 by pivoting of bar 128 in a clockwise direction as viewed in FIG. 5 about the mounting 130, thus withdrawing the nose 136 and the operative part of the edge 134 leftwards beyond the edge 132 as viewed in FIG. 5. The fixed part 126 with the slot 138 thus acts as a yarn catching means for receiving the yarn form the pivotal part 134. The pivotal motion of the part 134 is conveniently produced by means of an electromagnetic device 140 acting on an extension 142 integral with the bar 128 and extending at right angles thereto.

After formation of an adequate number of reserve windings in groove 122, yarn Y is returned towards the clamping point by anti-clockwise pivoting of bar 128 about its pivot 130, the yarn now being engaged by means in the form of an inclined edge 144 on the bar 128 which edge 144 forces the yarn out of slot 138, but the yarn is restrained against movement towards its shortest path length by a means in the form of a second nose 146 on bar 128.

Bar 128 is pivoted back to its initial position, but the yarn is returned only as far as the position Y3 in which it is restrained by the nose 146 and also rests in contact with an edge 150 on the bar 128. The slot in bar 128 formed between nose 146 and edge 144 is deep enough to ensure contact of the yarn with edge 150 in this final restrained position of the yarn. During this time, the yarn forms an overwarp over the yarn tail extending from the yarn reserve to the end of the bobbin.

The yarn is finally release by a second clockwise pivotal movement of bar 128 on its mounting 130. As soon as the restraining action of nose 146 is released, the yarn slides over edge 150 towards the traverse zone T. Edge 150 is slightly inclined to ensure motion of the yarn in the desired direction.

CONICAL BOBBINS

The gripper 30 must be adapted to conical bobbins by replacement of a yoke 68 (FIG. 4) with roller assemblies 74, 78 suited to cylindrical bobbins by a yoke with roller assemblies suited to the conicity of the bobbins to be gripped. For this purpose, the angle of offset of the shafts 98 of the roller assemblies relative to the axis of the shaft 60 is adapted to the bobbin conicity as well as to the skew required to produce the holding force F (FIG. 2).

COMPLETE DOFFING OPERATION

A complete package ejection/bobbin insertion sequence, and a complete set of equipment appropriate thereto, will vary substantially depending upon both the machine-type and the detailed design thereof. Purely by way of example, for the sake of completeness of the present specification, a complete set of equipment suitable for operating upon a specific design of open end spinning machine will be listed and very briefly described in the following.

It is assumed that the open end spinning machine is of the type in which package winding is stopped when the package has reached a predetermined length, and the cradle mechanism is operated to lift the fully-wound package through a short distance away from the friction drive roll 10. In this "lifted-off position", the package awaits the arrival of the service tender.

After being located in registry with the spinning station, the tender first operates a "cradle lift" lever which engages the arm 16 of the cradle mechanism and lifts it to its uppermost position. As already described, the cradle will be maintained in this position by the cradle mechanism of the machine. The tender then moves out a "doffing lever" which engages the underside of the package to support it. Further, the tender moves out an "upper cradle opener" which opens the cradle as described with reference to FIG. 2 in order to release the package, which is thereupon moved away from the cradle mechanism by the doff lever to a position at which the package is taken over by transport means on the machine. The doff lever is then withdrawn and the bobbin insertion arm is operated to bring a bobbin to the transfer location as described with reference to FIGS. 1 and 3. The upper cradle opener is then operated to close the cradle; this opener also exerts a grip on the lever 16 and, after closing of the cradle, forces the cradle downwardly, initially against the action of the cradle mechanism.

When the cradle has passed over the dead point of the over-centre mechanism, the upper cradle opener releases its grip on the cradle, and control of lowering of the cradle to the winding position is taken over by the cradle lift lever.

When the bobbin has been brought to the winding position, the cradle lift lever is withdrawn and the thread reserve device (FIG. 2) is moved to its initial position. A "lower cradle opener" (44, FIG. 2) is now operated to re-open the cradle, the bobbin being held in position by the gripper 30, as already described with reference to FIG. 2. The thread manipulating device 48, with its attached knife edge 52, is then moved to bring the yarn into a position ready for clamping. The further operations have already been fully described.

In the preferred arrangement, however, the package/bobbin is held by clamping pressure applied to its ends; any convenient means may be used for this purpose. The terms "bobbin" and "bobbin tube" used herein are intended to be synonymous. The term "doffing" as used herein refers to an operating sequence including both package ejection and fresh bobbin insertion.

The machine type referred to in the first full sentence of this specification is referred to in the appended claims as "a yarn handling machine of the type described". The terms "cradle means" and "cradle mechanism" used herein are synonymous.

We claim:

1. In a yarn handling machine, the combination comprising a rotatable friction drive roll;

a cradle mechanism having a pair of arms for receiving a bobbin therebetween in a yarn winding position at said drive roll;

a carrier for movement between a bobbin collection position and said yarn winding position; and a gripper mounted on said carrier for receiving a bobbin at said collection position and moving the gripped bobbin to said yarn winding position while imparting an axial force on the bobbin in said yarn winding position to press the bobbin against one of said arms of said cradle mechanism.

2. The combination as set forth in claim 1 wherein said gripper includes at least one roller assembly for engaging and rotating a received bobbin in said yarn winding position in response to rotation of the bobbin and drive roll.

3. The combination as set forth in claim 2 wherein said roller assembly includes a rotatable shaft mounted on an axis of rotation skew to the received bobbin.

4. The combination as set forth in claim 2 wherein said roller assembly engages the received bobbin in said collection position.

5. In a yarn handling machine, the combination comprising a rotatable friction drive roll;

a cradle mechanism having a pair of arms for receiving a bobbin therebetween, said mechanism being movable into a yarn winding position at said drive roll; and a bobbin gripper movably mounted between a bobbin collection position and said yarn winding position, said gripper including at least one roller assembly engaged between a bobbin at said winding position and said drive roll to impart an axial force on the bobbin in response to rotation of said drive roll to press the bobbin against one of said arms of said cradle mechanism whereby the other arm of said cradle mechanism can be moved from the bobbin to permit clamping of a yarn between the bobbin and said other arm.

6. A service tender for movement along a plurality of operating stations of a yarn handling machine, said service tender including;

a carrier mounted for movement between a bobbin collection position and a yarn winding position; and a gripper mounted on said carrier for receiving a bobbin at said collection position and moving the gripped bobbin to said yarn winding position while imparting an axial force on the bobbin in said yarn winding position.

7. A service tender as set forth in claim 6 wherein said gripper includes at least one roller assembly for engaging and rotating a received bobbin in said yarn winding position.

8. A service tender as set forth in claim 7 wherein said roller assembly includes a rotatable shaft mounted on an axis of rotation skew to the received bobbin.

9. A service tender as set forth in claim 7 wherein said roller assembly engages the received bobbin in said collection position.

* * * * *

UNITED STATES PATENT AND TRADEMARK OFFICE

CERTIFICATE OF CORRECTION

PATENT NO. : 4,595,151

DATED : June 17, 1986

INVENTOR(S) : Walter Slavid et al.

It is certified that error appears in the above-identified patent and that said Letters Patent is hereby corrected as shown below:

Column 1, lines 59-63 cancel "The ...station."

Column 3, line 32 "is" should be -in-

Column 3, line 57 "so to" should be -so as to-

Column 5, line 10 "di position" should be -disposition-

Column 6, line 39 "to" should be -from-

Column 9, line 52 "form" should be -from-

Signed and Sealed this

Twentieth Day of January, 1987

*Attest:*

*Attesting Officer*

DONALD J. QUIGG

*Commissioner of Patents and Trademarks*